US005146153A

United States Patent [19]

Luchaco et al.

[11] Patent Number: 5,146,153

[45] Date of Patent: Sep. 8, 1992

[54] WIRELESS CONTROL SYSTEM

[76] Inventors: David G. Luchaco, 1362 Heather Cir., Macungie, Pa. 18062; Stephen J. Yuhasz, Box 248, Rte. 1, Zionsville, Pa. 18092; David Buehler, Spring Valley Rd., Bethlehem, Pa. 18015; Raphael K. T. Tang, 11 Frost Rd., Belmont, Mass. 02178; Joel S. Spira, RD #1, Box 405A, Coopersburg, Pa. 18036

[21] Appl. No.: 430,922

[22] Filed: Nov. 1, 1989

Related U.S. Application Data

[63] Continuation of Ser. No. 79,847, Jul. 30, 1987, abandoned.

[51] Int. Cl.[5] ..... G05F 3/02

[52] U.S. Cl. ..... 323/324; 323/905; 315/DIG. 4; 315/291; 340/825.69

[58] Field of Search ..... 323/239, 324, 325, 326, 323/327, 905, 909; 307/112, 113, 114–116, 125; 315/158, 291, DIG. 4; 200/5 B, 536, 5 E; 361/160; 364/492, 493; 340/825.69, 825.72; 341/176; 358/194.1; 455/603; 446/454, 456

[56] References Cited

U.S. PATENT DOCUMENTS

| | | | |
|---|---|---|---|
| 2,428,297 | 9/1947 | Seeley | 250/2 |
| 2,565,540 | 8/1951 | Williams | 318/28 |
| 3,488,632 | 1/1970 | Clark, III | 340/171 |
| 3,746,923 | 7/1973 | Spira et al. | 338/179 X |
| 4,060,735 | 11/1977 | Pascucci et al. | 307/3 |
| 4,241,331 | 12/1980 | Taeuber et al. | 340/167 R |
| 4,388,567 | 6/1983 | Yamazaki et al. | 315/291 |
| 4,523,128 | 6/1985 | Stamm et al. | 315/DIG. 4 X |
| 4,538,973 | 9/1985 | Angott et al. | 417/572 |
| 4,563,592 | 1/1986 | Yuhasz et al. | 323/905 X |
| 4,617,002 | 10/1986 | Ishimoto et al. | 446/456 X |
| 4,633,514 | 12/1986 | Fimoff et al. | 455/151 |
| 4,678,985 | 7/1987 | Moskin | 323/324 |
| 4,684,822 | 8/1987 | Angott | 340/825.69 X |
| 4,689,547 | 8/1987 | Rowen et al. | 323/239 |

FOREIGN PATENT DOCUMENTS

| | | | |
|---|---|---|---|
| 0014372 | 5/1965 | Australia . | |
| 0014373 | 5/1968 | Australia . | |
| 3009040 | 9/1981 | Fed. Rep. of Germany | 446/456 |

OTHER PUBLICATIONS

Solid State Electronic Light control–Dynasty 2000 Touch Dimmer–Advanced Technology Products, Inc. Domestic and Commercial Control–Home Automation Limited, pp. 6, 7.

Nikko America Inc. Catalog, Dec. 30, 1985, pp. 1–22.

*Primary Examiner*—Steven L. Stephan

*Assistant Examiner*—Kristine Peckman

[57] ABSTRACT

A remote wireless load control system wherein the power supplied to a load can be varied from a remote location using a remote control device not electrically wired to the load. The load control system includes a transmitter and a receiver, each having a control actuator for adjusting the power supplied to the load. Control can be conferred upon either the transmitter or the receiver immediately upon manipulation of the control switch, with the adjustment in power level occurring substantially instantaneously upon manipulation of the control actuator. Transmission of load level information between transmitter and receiver is by digitally pulse-coded infrared signal.

90 Claims, 9 Drawing Sheets

TDA3047
+24 FW
+5
VT
ANALOG SIGNAL
TAKE COMMAND
CLOSE
OPEN
ON/OFF IN
80A+80B

BLOCK DIAGRAM OF LOCAL CONTROL STATIONS

MANUAL CONTROL STATION SCHEMATIC

WIRELESS CONTROL SYSTEM

This application is a continuation of application Ser. No. 079,847, filed Jul. 30, 1987 now abandoned.

This invention relates to an electrical control system, and more particularly to a novel, wireless, electrical load control system wherein control of the power supplied to a load may be varied from a remote location using a remote control device not electrically wired to the load.

Although the invention is described with reference to control of lighting level, it has application in other areas such as the control of sound volume, tone or balance; video brightness or contrast; the tuning setting of a radio or television receiver; and the position, velocity or acceleration of a movable object.

Load control systems are known in which the power supplied to the load can be adjusted by control units mounted at one or more different locations remote from the power controller. The control units are typically connected to the controller using two or three electrical wires in the structure in which the load control system is used. In an advanced version of such systems, control is transferred between different locations immediately upon manipulation of a control switch without the need for any additional overt act by the user. See, for instance, U.S. Pat. No. 4,689,547, issued Aug. 25, 1987, to Rowen et al. application Ser. No. 857,739, filed Apr. 29, 1986.

To permit greater user flexibility and to permit installation of a load control system with no modification of the existing wiring system in the structure, load control systems have been modifed to incorporate wireless remote control units. For example, a known type of light dimming system uses a power controller/receiver and a remote control transmitter for transmitting a control signal by radio, infrared, ultrasonic or microwave to the power controller/receiver. In such a system, it is only possible to cause the light level to be raised or lowered at a predetermined fixed rate and it is not possible to select a particular light level directly, nor is there any visual indication at the transmitter of the light level selected. In such a system, a lag of two to ten seconds typically exists between actuation of the transmitter and achievement of the desired light level.

Especially at the higher end of the range, this lag tends to limit the commercial acceptability of such systems.

Alternative load control systems have been produced that incorporate wireless remote controls where the desired light level is reached instantaneously on operation of the remote control unit. Unfortunately, these systems only allow the selection of three or four light levels that have been previously programmed at the power controller/receiver; usually it is not possible to select one of an essentially continuous range of values.

In the case of the systems using radio waves for the control signal transmission medium, the transmitter is often larger than is commercially desirable so as to accommodate the radio transmitting system, and an antenna must frequently be hung from the controller/receiver.

Remote control systems are frequently incorporated in television sets. In these systems a switch on the transmitter must typically be maintained in a depressed position until the desired load level, e.g., volume, is reached, with a time lag typically existing between the depression of the switch and achievement of the desired load level. Model airplanes are typically controlled by remote radio control where a control signal is typically continually transmitted during the operation of the airplane. It is possible, however, to select the control signal from an essentially continuous range of values.

Generally, in the known wireless remote load control systems, change in the power input to the load does not substantially instantaneously track with adjustment of the remote control transmitter except as noted above. Also, the existing systems typically do not have control actuators on either the transmitter or power controller/receiver with means for conferring control respectively on either the transmitter or power controller/receiver immediately upon manipulation of the control actuator of either.

A primary object of the present invention is to provide a remote, wireless load control system incorporating a wireless remote control device wherein power supplied to the load is adjusted through a continuous range of values immediately as the control actuator of the wireless remote control device is manipulated, and wherein the control signal need not be continually transmitted.

Other objects of the present invention are to provide a wireless, remote, electrical load control system having a power controller, a receiver, a control station, and a transmitter designed so that upon manipulation of the control actuator on the control station or the transmitter, control can be conferred on either the control station or transmitter substantially instantaneously without the need for any additional overt act by the user.

To achieve these and other obtects the invention generally comprises a novel wireless remote control dimmer system for controlling application of alternating current to a load. The system includes a power controller for varying the power supplied to the load pursuant to a control signal received at a receiver from a remote transmitter not wired to the receiver. In one embodiment, immediately upon manipulation of an actuator, such as a control slider coupled to a potentiometer in the remote transmitter, a control signal is sent to the receiver, the information contained in the signal depending upon the setting of the slider. The manipulation of the actuator can be detected by using switches as described hereinafter; or in response to touching a control plate, or by using a proximity detector operated by breaking or reflecting a beam or otherwise. The receiver uses this signal to adjust immediately the power supplied to the load by the power controller, for example by causing the gate signals to a power carrying device, such as a triac, connected between a power source and the load to be adjusted. Adjustment of the dimming actuator therefore causes an instantaneous, real-time change in the output of the load.

In an alternative embodiment, a slider-operated potentiometer is used to select the desired light level and then a switch means is operated to cause the control signal to be sent from transmitter to receiver. This allows the desired light level to be preselected from an essentially continuous range of values. The switch means can be a momentary close switch or can be operated in response to touching a control plate, breaking or reflecting a beam, or some other overt act. The momentary close switch can be associated with or mounted independently of the slider.

In both the embodiments described above, the output light level is directly related to the setting of the potentiometer slider and there is thus visual feedback at the transmitter of the selected light level.

An enhancement to the invention can be provided by providing a gradual change between the present light level and the desired light level after selection of the desired light level at the transmitter; i.e. a fade. Prior art raise/lower systems inherently have a gradual change between the present and desired light level, which can not be too fast lest adjusting the system to produce a desired output be too difficult or too slow. Fade time in the present system can be varied by the user within a wide range of values.

A potentiometer with control slider may also be provided in a control station for alternatively varying the power supplied to the load by the power controller. In such event, the system may be designed so that control is either transferred between the control station slider and the transmitter slider only by an overt act of the user, such as operating a momentary-close switching means associated with the slider in the transmitter, or by the act of manipulating the slider in the transmitter and without any additional overt act by the user.

Similarly control can be transferred between the transmitter slider and the control station slider by overtly operating a switch on the control station or by the mere act of manipulating the slider on the control station.

The receiver can be mounted on a wall or ceiling, or it may be part of a wall, ceiling, table or floor lamp. Alternatively, the receiver can be combined with the power controller and attached to a line cord for plug-in connection and used to control an electrical outlet into which a lamp can be plugged.

The transmitter can be hand held or wall mounted. In either case it can be battery powered or powered from an A.C. line.

The present invention therefore permits adjustment of the power supplied to a load, typically an electrical lamp, from any position where the transmitter is in wireless communication with the receiver. Because the transmitter is not wired to the receiver, the system may be readily installed in existing installations without extensive rewiring.

For a fuller understanding of the nature and objects of the invention, reference should be had to the following detailed description taken in connection with the accompanying drawings wherein.

Figure 1:
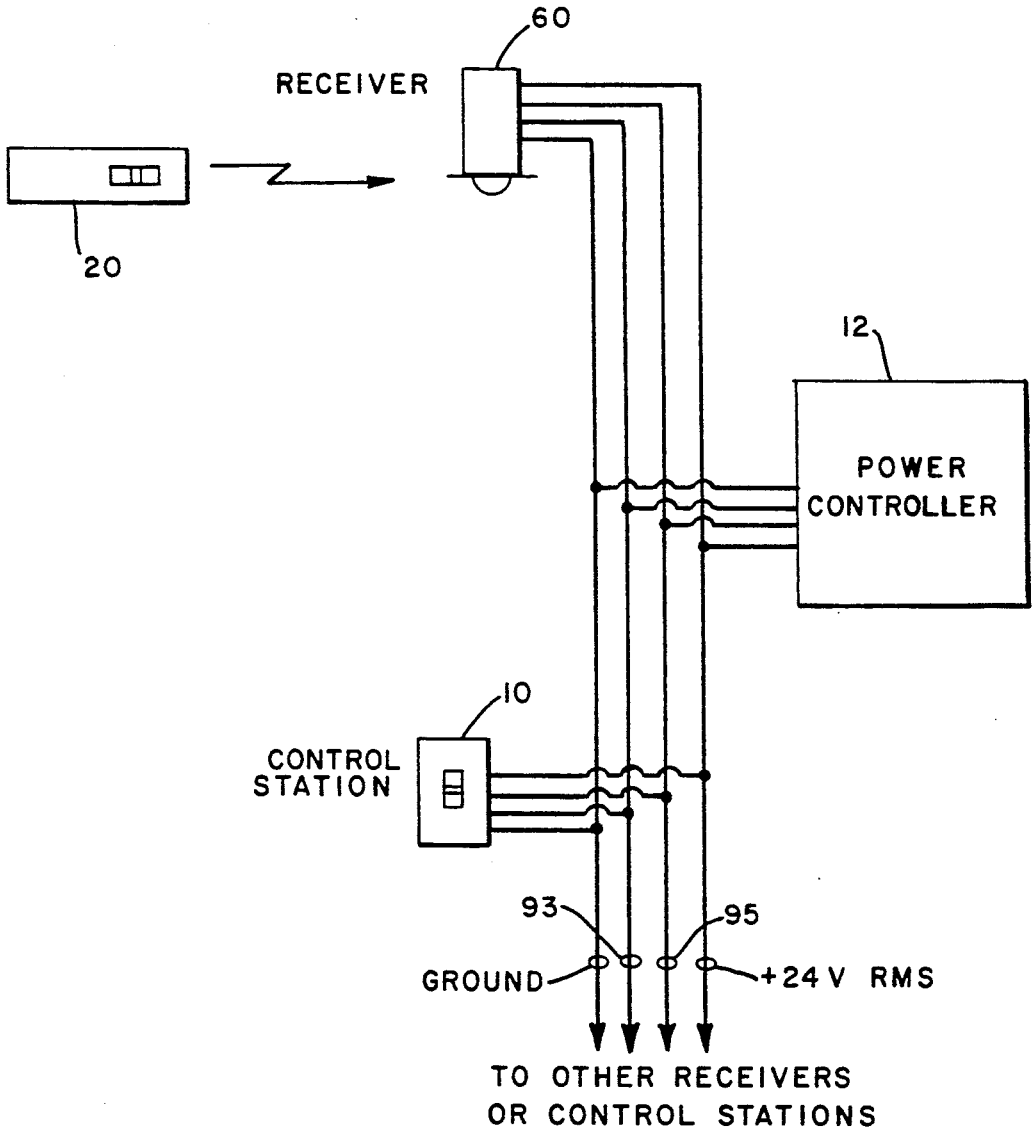
FIG. 1 is a block diagram showing an overview of the control system of the present invention.

In the drawings, wherein like reference numerals denote like parts, the remote wireless, load control system of the present invention is described in FIG. 1. The latter includes transmitter 20, typically an infrared transmitter, and a receiver 60 therefor. The embodiment of FIG. 1 also includes control station 10 and power controller 12. Control station 10, receiver 60 and power controller 12 are linked together typically by a four-wire bus, the latter consisting, for example, of a +24 Vrms line, a ground line, analog signal line 93 and take command line 95.

Figure 2A:
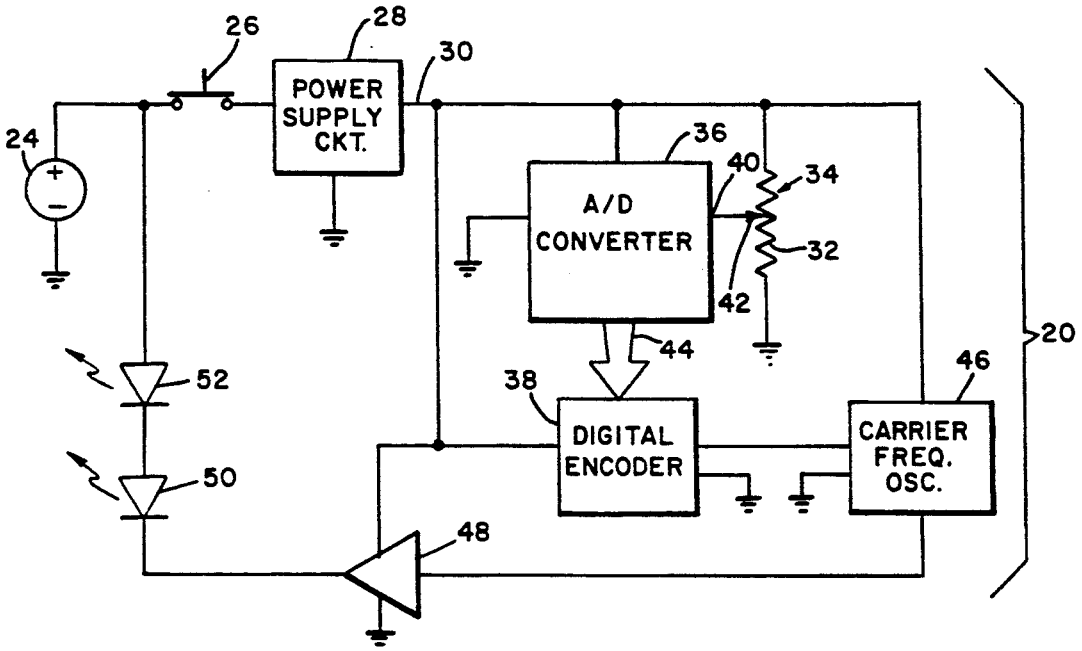
FIG. 2A is a block diagram showing one form of the transmitter of the present invention.

As described in FIG. 2A, transmitter 20 includes DC power source 24, typically a nine volt battery, connected between transmitter ground and one side of switch 26. The latter is preferably a normally open, single-pole, single-throw (SPST) momentary pushbutton-type switch that, when closed, serves to connect power source 24 to power supply circuit 28. Power supply circuit 28 is included to provide a stable, regulated voltage source and can be readily implemented in the form of a LM 2931Z integrated circuit manufactured by National Semiconductor Corporation.

Power output line 30 from power supply circuit 28 is connected to one end of resistive impedance 32 of slide-operated potentiometer 34, the other end of impedance 32 being coupled to ground. Power line 30 is also connected to provide the requisite power input to analog-to-digital converter 36, digital encoder 38, carrier frequency oscillator 46 and amplifier 48. Each of these latter devices is also connected to transmitter ground.

Analog-to-digital converter 36, typically a commercially available integrated circuit such as ADC0804 of National Semiconductor Corporation, is provided for converting an analog signal into a parallel digital output. To this end, analog input terminal 40 of converter 36 is connected to manually operable wiper 42 of potentiometer 34, wiper 42 being a conventional potentiometer wiper, configured to move typically linearly or along a curved path of operation in contact with resistive impedance 32. Adjustment of wiper 42 varies the resistive impedance of potentiometer 34 over a continuum of values. Parallel output digital databus 44 of converter 36 is connected as the data input to encoder 38, the latter typically being a commercially available integrated circuit such as MC145026 of Motorola Corporation that produces serially encoded data. The data output terminal of encoder 38 is connected to the data input terminal of carrier frequency oscillator circuit 46, the latter being exemplified in an ICM7556 integrated circuit manufactured by Intersil, Inc., Cupertino, Calif.

The output of oscillator circuit 46 is connected to the cathode of the first of a pair of series-connected infrared light-emitting diodes 50 and 52 through amplifier 48. The anode of diode 52 is connnected to the positive terminal of power source 24. By mounting switch 26 on the actuator of potentiometer wiper 42, the transmitter can be operated in two different modes, track and preset, as detailed hereinafter.

Figure 2B:
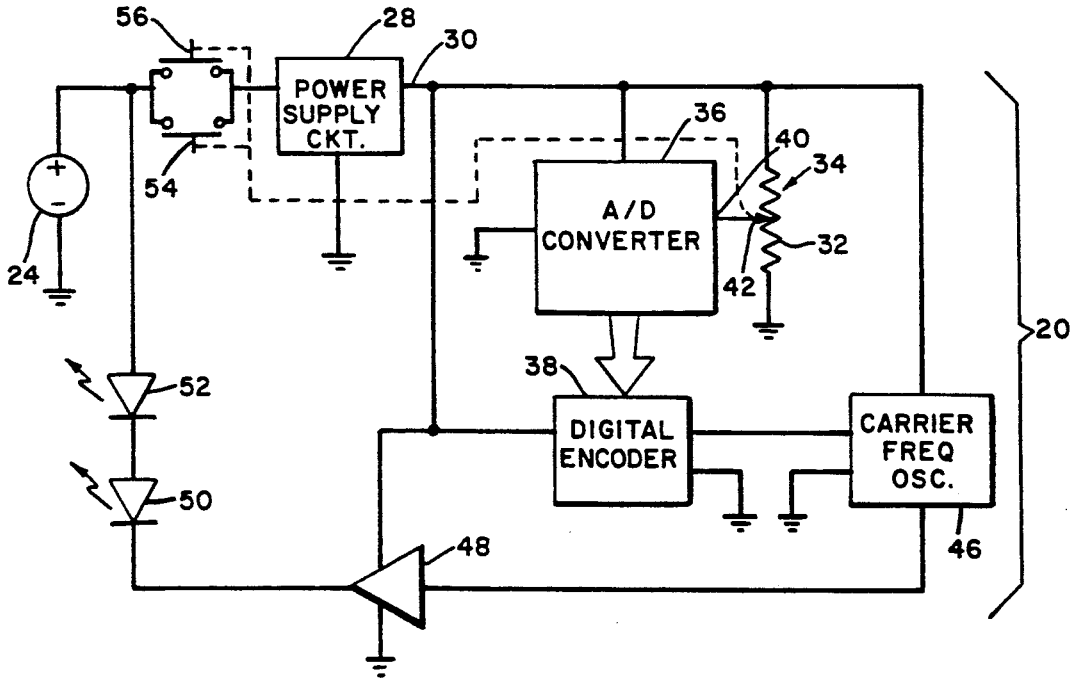
FIG. 2B is a block diagram showing an alternative form of a transmitter of the present invention.

In an alternative form of the transmitter of the present invention, as shown in FIG. 2B, switch 26 is omitted and power supply 24 is connected to the input of power supply circuit 28 through a pair of parallel, normally open, single-pole, single-throw spring-loaded pushbutton momentary close switches 54 and 56. The latter are mechanically coupled, as indicated by the dotted line, to wiper 42 so that one of the switches is momentarily closed while the wiper is being moved in one direction, the other switch being momentarily closed while the wiper is moved in the opposite direction. Thus, motion of the wiper in either direction closes one or the other of the two switches, energizing power supply 28 and providing the requisite or desired analog signal to A/D converter 36. Details of a switching mechanism particularly useful as switches 54 and 56 are disclosed in the aforementioned U.S. Pat. No. 4,689,547, and the same is incorporated herein by reference.

Figure 3:
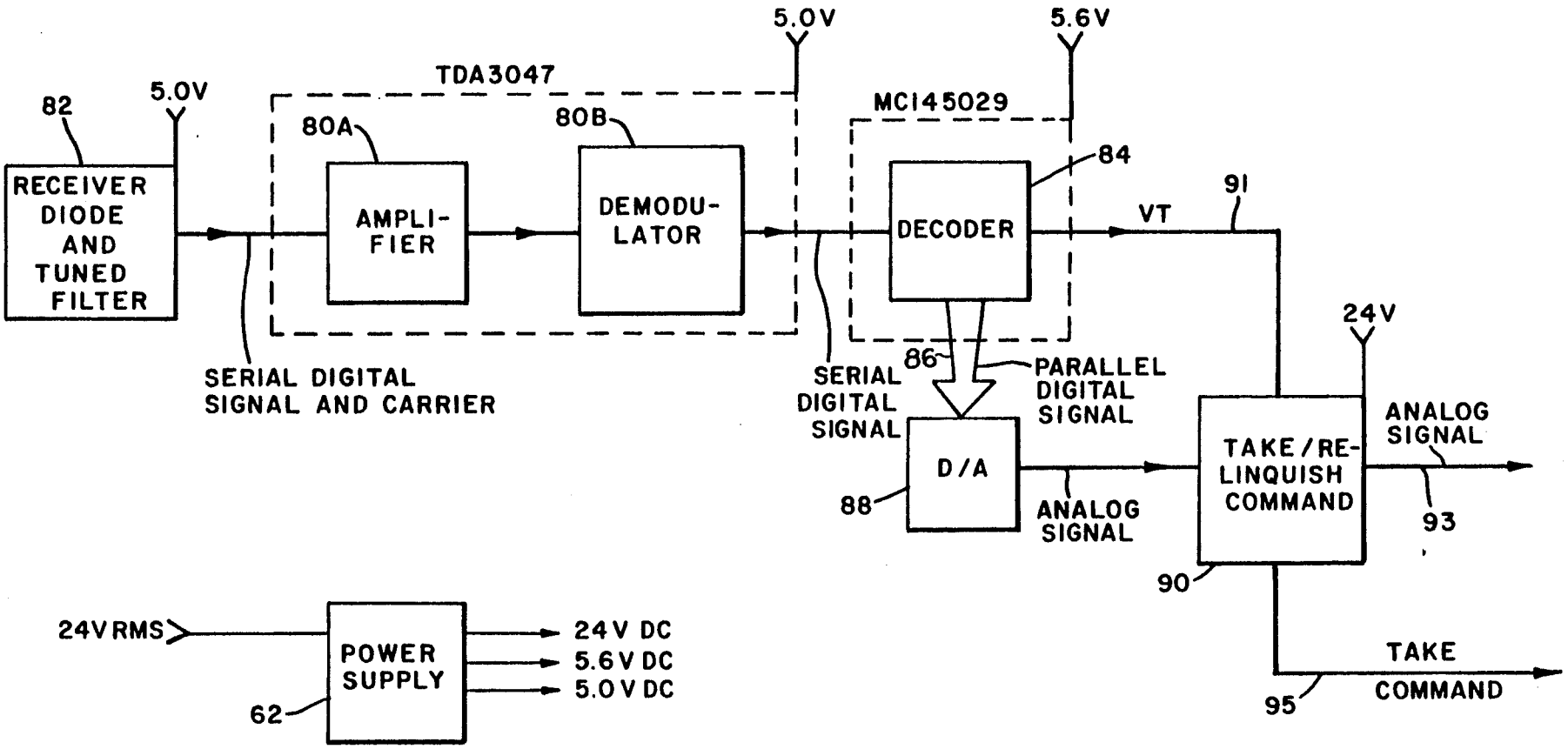
FIG. 3 is a block diagram of the receiver of the present invention.

Receiver 60, as shown in FIG. 3, is designed to be contained in a housing typically adapted for mounting in or on a wall (not illustrated) or in or on a ceiling (See FIG. 9A), but can be free standing if desired or adapted to be mounted as a part of the power controller circuit.

Receiver 60 includes power supply circuit 62 having its input coupled to a source of 24 Vrms. Outputs of 24 VDC, 5.6 V DC (regulated) and 5.0 V DC (unregulated) are provided. The 24 VDC output of power supply circuit 62 is coupled as a power input to take/relinquish command circuit 90. The 5.6 V DC output of power supply circuit 62 is coupled, as a power input, to decoder circuit 84. The 5.0 V DC output of power supply circuit 62 is coupled, as a power input, to amplifier/demodulator circuit 80A/80B and receiver diode and tuned filter circuit 82.

Infrared signals are received by a receiver diode or diodes and selected by using a tuned circuit in receiver diode and tuned filter circuit 82. The output of the receiver diode is a serial digital signal modulating a carrier. It is connected to the input of amplifier circuit 80A, the output of amplifier circuit 80A being connected to the input to demodulator circuit 80B. The output of demodulator circuit 80B is a serial digital signal that is connected to the signal input terminal of decoder circuit 84. Amplifier circuit 80A and demodulator circuit 80B may be implemented by using a TDA 3047 integrated circuit, as manufactured by Signetics.

The receiver diode is preferably mounted on or in the wall or ceiling mounted housing in such a manner that it can receive signals from the widest possible number of directions.

Decoder circuit 84 is provided for converting a serial digital signal at its signal input terminal to a parallel digital signal on signal output bus 86 and also to signal the Take/Relinquish command circuitry that a valid signal transmission has occurred. A suitable circuit is commercially available as an MC 145029 chip manufactured by Motorola. Output bus 86 is connected to the signal input terminals of digital-to-analog converter circuit 88. Valid transmission output line 91 is connected to a control input of take/relinquish command circuit 90. The signal output terminal of digital-to-analog converter circuit 88 is connected to a switch means in take/relinquish command circuit 90. When the valid transmission output signal on line 91 goes high, the switch means closes and the analog output signal appears on output line 93. Take command line 95 is connected to a second control input of take/relinquish command circuit 90. When the signal on this line goes low, the switch means in take/relinquish command circuit 90 opens and the analog output signal is removed from output line 93.

In operation of the transmitter of FIG. 2A, when switch 26 is closed, the transmitter circuit is powered by source 24, at least during the time that switch 26 remains depressed. During that time, the analog signal provided by the position of wiper 42 in potentiometer 34 is sampled by A/D converter 40 and converted into digital signals in the form of parallel bits available on bus 44. Encoder 38 serves to encode the parallel bits of the digital signal into a single line, serial-encoded data signal, thereby conferring relative noise immunity for decoding at the receiver side. The serial-encoded data signal is fed into oscillator 46 to provide amplitude modulation of the carrier frequency generated by the oscillator. Such modulation is intended to provide a high signal-to-noise ratio for infrared detection on the receiver side as will be described hereinafter. The duty cycle of the carrier frequency oscillations is approximately 20% to reduce power consumption. The amplitude modulated signal from oscillator 46 is then amplified in amplifier 48 to power infrared light-emitting diodes 50 and 52. It should be apparent to those skilled in the art that the integrated circuit chips and the modulation scheme selected insure very low power consumption, and that other integrated circuits and modulation schemes may also be utilized.

The circuit of FIG. 2A can be used in two different modes. In a first mode, referred to as tracking mode, one simply holds switch 26 down and adjusts the setting of wiper 42 on potentiometer 34. The lighting level consequently provided, as will be apparent hereinafter, will vary proportionately as the potentiometer is adjusted giving control over the power fed to the load substantially instantaneously in accordance with the position of the slider relative to resistive impedance 32. In an alternative mode, referred to as preset mode, one can first adjust the potentiometer and then momentarily close switch 26. Closure of switch 26 then effectively instantly adjusts the power flow to the load at a level indicated by the position at which the potentiometer was set.

An infrared signal from transmitter 20, when received by infrared receiver diode 82, is converted to an electrical signal by the diode and applied to the input of pre-amplifier circuit 80. The latter selects the signal at the desired carrier frequency, amplitude demodulates to strip the carrier frequency, and amplifies the demodulated signal to obtain the serial-encoded signal sent by transmitter 20. The serial-encoded signal is then applied to the input of decoder 84. To ensure that the data to be decoded are valid, decoder circuit 84 preferably includes, in known manner, timing elements preset to match the timing of the serial-encoded data transmitted from diodes 50 and 52. When two consecutive valid data words are received from pre-amplifier 80, decoder circuit 84 provides a decode enable signal and applies it to line 91. Additionally, the decoder output which is a parallel bit digital signal, is latched internally and provided to bus 86. That parallel signal is then converted in D/A converter circuit 88 into an analog signal applied to one of the signal inputs of switch means 90. Because the decoder output is latched, the D/A conversion need not be synchronous.

Application of an enable signal on line 91 resets the state of the switches in switch means 90 so that the output from D/A converter circuit 88 is connected to analog signal line 93 of switch means 90.

The enable signal on line 91 can also be used to drive a signal received indicator light, which is especially useful when the load under control is remote from the receiver.

The operation of the transmitter of FIG. 2B is similar to the operation of the transmitter of FIG. 2A in its 'track' mode. The difference is that either switch 54 or switch 56 is closed automatically as the wiper 42 is moved and hence the operator of the system merely has to move the wiper 42 in the desired direction to send the appropriate signal; there is no necessity to operate overtly another switch.

Figure 4:
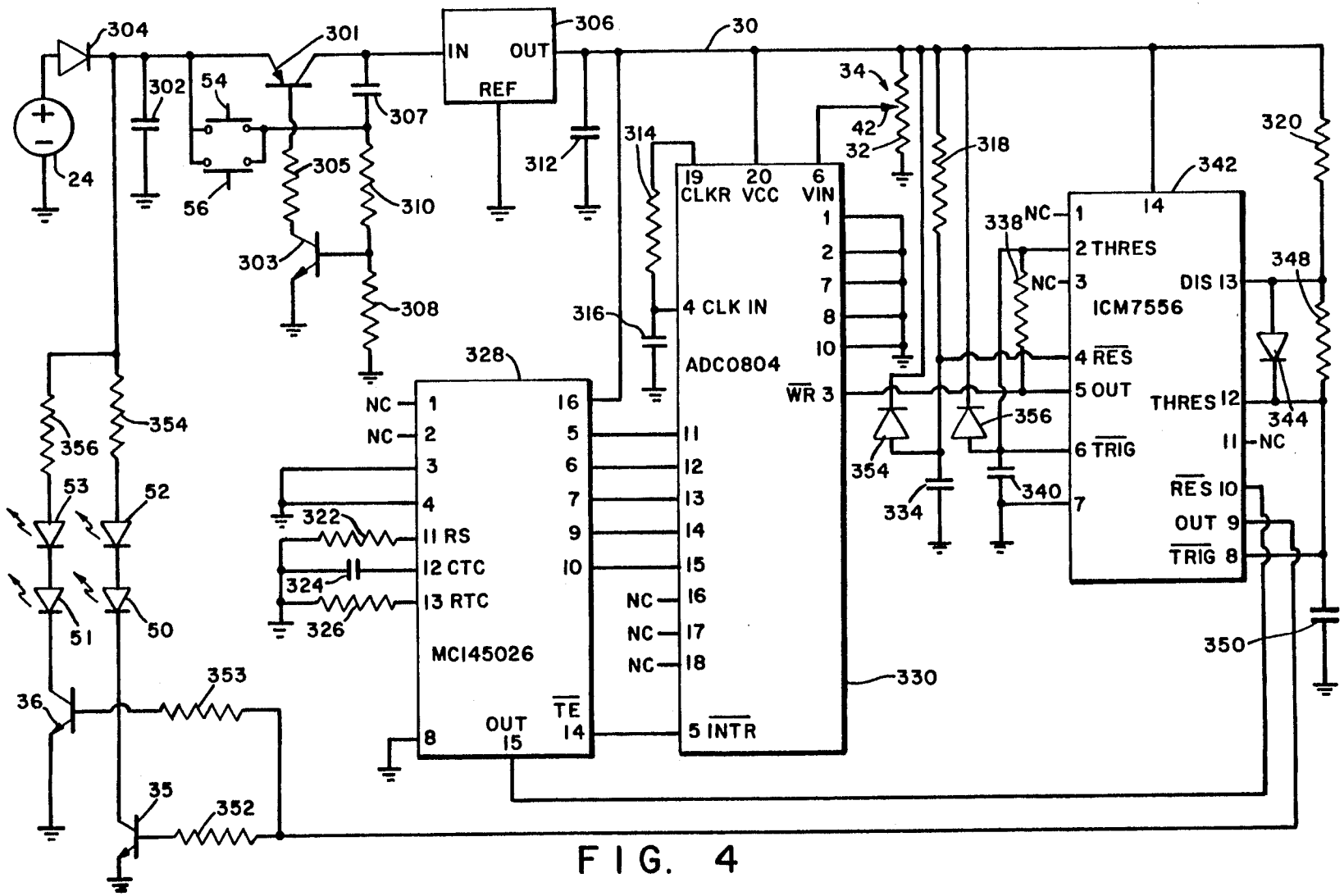
FIG. 4 is a circuit schematic of the transmitter embodiment of FIG. 2B of the present invention.

The embodiment of transmitter 20 illustrated schematically in FIG. 4 includes D.C. power source 24, connected between system ground and the anode of protection diode 304. The cathode of diode 304 is connected to the emitter of transistor 301. Capacitor 302 is connected in parallel with power source 24 and diode 304. The collector of transistor 301 is connected to the input terminal of voltage regulator 306. The base of transistor 301 is connected through resistor 305 to the collector of transistor 303, and the emitter of the latter is connected to ground. The base of transistor 303 is connected to respective terminals of resistor 308 and resistor 310. The other terminal of resistor 308 is grounded and the other terminal of resistor 310 is connected to one terminal of capacitor 307 and of switches 54 and 56. The other terminals of switches 54 and 56 are connected to the emitter of transistor 301. The other terminal of capacitor 307 is connected to the collector of transistor 301. The reference terminal of voltage regulator 306 is connected to ground. The output terminal of voltage regulator 306 is connected to power output line 30. Capacitor 312 is connected between power output line 30 and ground.

Power output line 30 is connected to one end of resistive impedance 32 of slide-operated potentiometer 34, the other end of resistive impedance 32 being connected to ground. Power output line 30 is also connected to pin 16 of digital encoder circuit 328, to pin 20 of analog-to-digital converter circuit 330 and to pin 14 of oscillator circuit 342.

Manually operable wiper 42 of potentiometer 34 is connected to the voltage input terminal at pin 6 of analog-to-digital converter circuit 330. Resistor 314 is connected between CLK R input at pin 19 and CLK IN input at pin 4 of converter circuit 330. Timing capacitor 316 is connected between CLK IN input pin 4 of converter circuit 330 and ground. $\overline{CS}$ at pin 1, $\overline{RD}$ at pin 2, VIN(−) at pin 7, A GND at pin 8 and D GND at pin 10 of convertor circuit 330 are all connected to ground. The data output connections at pins 11, 12, 13, 14 and 15 of converter 330 are connected to data input connections at pins 5, 6, 7, 9 and 10 of encoder circuit 328 respectively. The interrupt request $\overline{INTR}$ output at pin 5 of converter 330 is connected to transmit-enable input $\overline{TE}$ at pin 14 of encoder 328. The write request WR input at pin 3 of converter 330 is connected to the output at pin 5 of oscillator 342.

Timing circuit capacitor 324 is connected between CTC connection at pin 12 of encoder 328 and the common junction of resistor 322, timing resistor 326 and ground. The other end of resistor 322 is connected to RS connection at pin 11 of encoder 328 and the other end of timing resistor 326 is connected to RTC connection pin 13 of encoder 328. Pins 3, 4 and 8 of encoder 328 are connected to ground. The output at pin 15 of encoder 328 is connected to $\overline{RES}$ at pin 10 of carrier frequency oscillator 342.

Resistor 320 is connected between power output line 30 and the discharge connection pin 13 of oscillator 342. The anode of diode 344 is connected to pin 13 of oscillator 342. The cathode of diode 344 and one end of resistor 348 are connected to the threshold (THRES) input at pin 12 of oscillator 342. The other end of resistor 348 is connected to pin 13 of oscillator 342. Threshold input pin 12 is further connected to trigger input pin 8 of oscillator 342, and one end of timing capacitor 350. The other end of timing capacitor 350 being connected to ground. The output at pin 9 of oscillator 342 is connected to respective one ends of resistors 352 and 353.

A sampling frequency oscillator forms part of oscillator 342. Timing capacitor 340 is connected between trigger input pin 6 of oscillator 342 and ground. Trigger input $\overline{TRIG}$ at pin 6 is further connected to the threshold input THRES at pin 2 of oscillator 342. Timing resistor 338 is connected between pin 2 and output pin 5 of oscillator 342. Pin 6 of oscillator 342 is connected to the anode of protection diode 356, the cathode of the latter being connected to power output line 30. Power on reset capacitor 334 is connected between ground and reset input $\overline{RES}$ at pin 4 of oscillator 342. Power on timing resistor 318 is connected between pin 4 of oscillator 342 and power output line 30. Pin 4 of oscillator 342 is connected to the anode of protection diode 354, the cathode of the latter being connected to power output line 30.

The other side of resistor 352 is connected to the base of transistor 35. The emitter of transistor 35 is connected to ground, the collector of transistor 35 being connected to the cathode of infrared light emitting diode 50. The anode of infrared light emitting diode 50 is connected to the cathode of infrared light emitting diode 52, the anode of the latter being connected to the cathode of diode 304 through resistor 354.

Similarly, the other side of resistor 353 is connected to the base of transistor 36. The emitter of transistor 36 is connected to ground, the collector of transistor 36 being connected to the cathode of infrared light emitting diode 51. The anode of infrared light emitting diode 51 is connected to the cathode of infrared light emitting diode 53, the anode of the latter being connected to the cathode of diode 304 through resistor 356.

The operation of the transmitter of FIG. 4 is as follows. On first inserting power source 24 into the transmitter and making connection to it, power supply capacitor 302 is charged up through protection diode 304. Power supply capacitor 302 serves to provide peak pulse currents to infrared light emitting diodes 50, 51, 52 and 53. Protection diode 304 prevents discharge of power source 24 and damage to transmitter circuitry in the event the power source 24 is miswired.

Moving wiper 42 of potentiometer 34 causes either switch 54 or switch 56 to close. This in turn causes transistor 303 to turn on, followed by transistor 301 connecting power source 24 to voltage regulator 306 through protection diode 304 and transistor 301. In the preferred embodiment, the output voltage of regulator 306 is approximately 5 V. Capacitor 312 filters the output voltage on power output line 30, which is used to power the other circuit components.

Transistors 301 and 305 together with capacitor 307 and resistors 305, 308 and 310 form a "nagger" circuit that continues to provide voltage to regulator 306 for a short period of time after switches 54 or 56 are opened, hence enabling transmission to be completed with a stable signal from wiper 42. When switch 54 or switch 56 is opened, capacitor 307 keeps transistor 303 turned on until it is charged up through resistors 310 and 308, at which time transistors 303 and 301 turn off and capacitor 307 again discharges.

Wiper 42 of potentiometer 34 taps off an analog voltage from resistive element 32. This analog voltage is applied to the input terminal of analog-to-digital converter 330. Resistor 314 and capacitor 316 are external components of an internal clock circuit within analog-to-digital converter 330. Once the conversion process is completed, the digital output is latched onto pins 11, 12, 13, 14 and 15 of converter 330 and the $\overline{INTR}$ output on pin 5 is driven low. This transition is applied to the transmit-enable input pin 14 of encoder circuit 328 causing the encoder circuit to begin the encoding process using the data available at its input pins 5, 6, 7, 9 and 10. Resistors 322 and 326 and capacitor 324 are external components of an internal clock circuit within encoder circuit 328. The serially encoded output of encoder 328 appears at pin 15 which is connected to the $\overline{RES}$ input at pin 10 of oscillator 342.

Oscillator 342 is actually two oscillators. The first is a carrier frequency oscillator with connections at pins 8, 9, 10, 12 and 13. Capacitor 350, resistors 320 and 348, and diode 344 are timing components of the carrier frequency oscillator which serve to generate a high frequency (in the preferred embodiment 108 kHz) carrier but with a duty cycle of only 20% to reduce power consumption. The low duty cycle is achieved by the arrangement of resistor 348 and diode 344. The carrier frequency oscillations are output at pin 9 and are modulated by the serially encoded data stream applied to pin 10.

The second oscillator is used to control the sampling rate of analog-to-digital converter 330 and has connections at pins 2, 4, 5 and 6. Resistor 338 and capacitor 340 determine the output frequency on pin 5 (which in the preferred embodiment is 20 Hz). Diode 356 resets capacitor 340 when line 30 goes low at power off.

When switch 54 or 56 is first closed, the input to $\overline{RES}$ at pin 4 is low and prevents the second oscillator from functioning. This input voltage will rise as capacitor 334 is charged through resistor 318. Once the voltage rises above a threshold value the oscillator begins oscillating. In this manner, the oscillator is not gated on until any noise associated with the power up transition has died away. Diode 354 resets capacitor 334 when line 30 goes low at power off. The output from pin 5 of oscillator 342 is applied to the $\overline{WR}$ input at pin 3 of analog-to-digital converter 330 and hence controls the sampling rate.

The modulated output of carrier frequency oscillator 342 appears at pin 9 and is applied through resistor 352 to transistor 35 and through resistor 353 to transistor 36. The modulated output is amplified by transistors 35 and 36 and modulates the current flowing in infrared light-emitting diodes 50, 51, 52 and 53 to produce properly modulated infrared signals at the carrier frequency. Four light-emitting diodes are used to increase the range of the transmitter.

The presently preferred values of the resistors and capacitors of the embodiment of FIG. 4 are set forth in Table I below.

TABLE I

| VALUE | | |
|---|---|---|
| RESISTOR | IN OHMS | TOLERANCE |
| 34 | 250K(VAR) | |
| 305 | 10K | 5% |
| 308 | 68K | 5% |
| 310 | 100K | 5% |
| 314 | 6.8K | 5% |
| 318 | 100K | 5% |
| 320 | 1.5K | 5% |
| 322 | 39K | 5% |
| 326 | 18.2K | 1% |
| 338 | 1.5M | 5% |
| 348 | 27.4K | 1% |
| 352 | 15K | 5% |
| 353 | 15K | 5% |
| 354 | 1 | 5% |
| 356 | 1 | 5% |
| CAPACITOR | VALUE | TOLERANCE |
| 302 | 1500 uF | 20% |
| 307 | 1 uF | 10% |
| 312 | 100 uF | 10% |
| 316 | 220 pF | 10% |
| 324 | 4.7 nF | 10% |
| 334 | 100 nF | 10% |
| 340 | 22 nF | 10% |
| 350 | 220 pF | 1% |

In the preferred embodiment, the following components are employed. Diode 304 is a type 1N5817, diodes 344, 354 and 356 are all type 1N914. Infrared light-emitting diode 50, 51, 52 and 53 are type SFH484. Transistors 35 and 36 are MPS A29. Transistor 301 is an 2N5806, transistor 303 is a 2N4123. Voltage regulator 306 is a National Semiconductor LM 2931Z. Analog-to-digital converter 330 is a National Semiconductor ADC0804. Encoder circuit 328 is a Motorola MC145026. Oscillator 342 is an Intersil ICM7556. Power source 24 is a 9 V battery, Switches 54 and 56 can be any momentary contact switches, rated for dry circuit use, that can be coupled to potentiometer 34.

Skilled practitioners will appreciate that the integrated circuit chips and other components having somewhat different operating parameters may also be satisfactorily employed in the transmitter. Also it will be appreciated that the movement of wiper 42 can be detected electronically or optically instead of mechanically as by using switches 54 and 56.

Figure 5:
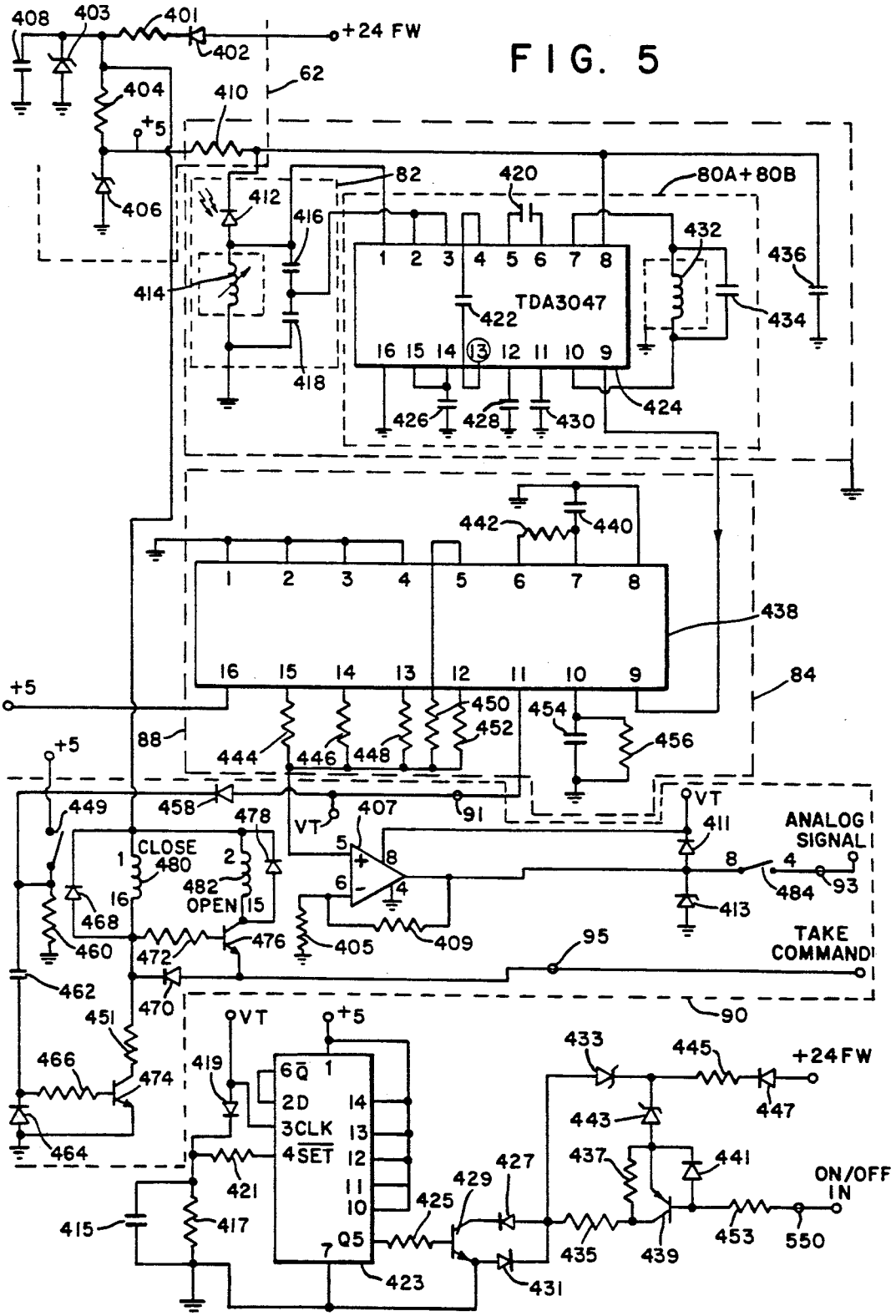
FIG. 5 is a circuit schematic of the receiver embodiment of FIG. 3 of the present invention.

The receiver embodiment illustrated schematically in FIG. 5 is the presently preferred embodiment of the receiver block-diagrammed in FIG. 3. Power supply 62 comprises diode 402, PTC resistor 401 resistors 404 and 410, zener diodes 403 and 406 and capacitor 408. The positive terminal of the 24 Vrms supply is connected to the anode of diode 402, the cathode being connected to one terminal of PTC resistor 401. The other terminal of PTC resistor 401 is connected to the cathode of zener diode 403, to one terminal of capacitor 408, and the V+ output of the power supply. The anode of zener diode 403 and the other terminal of capacitor 408 are connected to ground. The cathode of zener diode 403 is connected to one terminal of resistor 404. The other terminal of resistor 404 is connected in common to the cathode of zener diode 406, one terminal of resistor 410 and the 5 V output of the power supply. The anode of zener diode 406 is connected to ground. The other terminal of resistor 410 is connected to the cathode of receiver diode 412. The 24 V DC output of the power supply is connected to the anode of diode 447. The V+ output of the power supply is also connected to the cathode of diodes 468 and 478, to one terminal of relay coils 480 and 482 in take/relinquish command circuit 90, to the cathode of diode 411 and to the positive supply terminal of IC407. The 5.0 V output of the power supply is connected to the VDD terminal of decoder integrated circuit 438, to the positive supply terminal of amplifier/demodulator integrated circuit 424, to the supply terminal of timer 423, to one terminal of relay contact 449 and through capacitor 436 to ground.

Receiver diode and tuned filter circuit 82 comprise receiver diode 412, variable inductor 414, and capacitors 416 and 418. The cathode of receiver diode 412 is connected to the 5.0 V output of power supply 62 through resistor 410. The anode of receiver diode 412 is connected to one terminal of variable inductor 414, to one terminal of capacitor 416 and to the input limiter terminal of amplifier/demodulator circuit 424. The other terminal of variable inductor 414 is connected to ground. The other terminal of capacitor 416 is connected to one terminal of capacitor 418. The other terminal of capacitor 418 is connected to ground. The junction between capacitors 416 and 418 is connected to the controlled high frequency amplifier and Q-factor killer within amplifier/demodulator integrated circuit 424.

Amplifier/demodulator 80A/80B comprises amplifier/demodulator integrated circuit 424, capacitors 420, 422, 426, 428, 430 and 434 and inductor 432. Capacitors 420 and 422 are stabilization capacitors connected to the controlled high frequency amplifier within amplifier/demodulator integrated circuit 424. Capacitor 426 is a coupling capacitor connected to the controlled high frequency amplifier within amplifier/demodulator integrated circuit 424. Capacitor 428 is connected to the automatic gain control detector within amplifier/demodulator integrated circuit 424 and controls the acquisition time of the automatic gain control detector. Capacitor 430 is connected to the pulse shaper circuit within amplifier/demodulator integrated circuit 424 and controls its time constant. Capacitor 434 and inductor 432 are connected in parallel and are connected to the reference amplifier circuit within amplifier/demodulator circuit 424. The output of the amplifier/demodulator integrated circuit is connected to the input to decoder integrated circuit 438.

Decoder circuit 84 comprises decoder integrated circuit 438, resistors 442 and 456, and capacitors 440 and 454. The VSS terminal of decoder integrated circuit 438 is connected to ground. As noted above, the VDD terminal of decoder integrated circuit 438 is connected to the 5 V output of power supply 62. Resistor 442 is connected to the pulse discriminator pins of decoder integrated circuit 438. Capacitor 440 is connected between one of the pulse discriminator pins and ground. Together, resistor 442 and capacitor 440 set a time constant that is used to determine whether a wide or a narrow pulse has been encoded. Resistor 456 is connected in parallel with capacitor 454, and the parallel combination is connected between the dead time discriminator pin of decoder integrated circuit 438 and ground. These components set a time constant that is used to determine both the end of an encoded word and the end of transmission. The decoded data appears at the data outputs of decoder integrated circuit 438. Pins 1, 3 and 4 of decoder integrated circuit 438 are connected to ground.

Digital-to-analog convertor circuit 88 comprises resistors 444, 446, 448, 450 and 452. Each data output of decoder integrated circuit 438 is connected to a terminal of one of these resistors. The other terminal of each resistor is connected to the positive input of integrated circuit 407 in take/relinquish command circuit 90. The resistor values are selected such the the data word on the data output terminals of decoder integrated circuit 438 is converted to an analog voltage on the positive input terminal of integrated circuit 407.

Take/relinquish command circuit 90 comprises resistors 405, 409, 460, 466 and 472, capacitor 462, diodes 411, 413, 458, 464, 468, 470 and 478, transistors 474 and 476, relay coils 480 and 482, relay contacts 449 and 484, and integrated circuit 407. The valid transmission output terminal of decoder integrated circuit 438 is connected to the anode of diode 458 via line 91. The cathode of diode 458 is connected to one terminal of resistor 460 to one terminal of contacts 449 and to one terminal of capacitor 462. The remaining terminal of resistor 460 is connected to ground. The remaining terminal of contacts 449 is connected to a +5 V power supply. The remaining terminal of capacitor 462 is connected to the cathode of diode 464 and one terminal of resistor 466. The anode of diode 464 is connected to ground. The other terminal of resistor 466 is connected to the base of transistor 474. The emitter of transistor 474 is connected to ground and the collector is connected to one terminal of resistor 451. The other terminal of resistor 451 is connected to the cathode of diode 470, one terminal of resistor 472, one terminal of relay coil 480 and the anode of diode 468.

The other terminal of resistor 472 is connected to the base of transistor 476. The anode of diode 470 is connected to the emitter of transistor 476 and to take command line 95. The collector of transistor 476 is connected to one terminal of relay coil 482 and to the anode of diode 478. The cathodes of diodes 468 and 478 and the other terminals of relay coils 480 and 482 are connected to the V+ output of power supply 62. The negative input of integrated circuit 407 is connected to one terminal of resistor 405 and 409. The other terminal of resistor 405 is connected to ground. The other terminal of resistor 409 is connected to the output of integrated circuit 407, the anode of diode 411, the cathode of diode 413 and one terminal of relay contact 484. The cathode of diode 411 is connected to V+. The anode of diode 413 is connected to ground. The free terminal of relay contact 484 is connected to analog signal line 93.

Receiver 60 further includes light-emitting diode 427 and driving circuits comprising timer circuit 423, transistors 429 and 439 and associated components. Light-emitting diode 427 indicates whether power to the load is on or off and whether the receiver is receiving a signal, as is described in more detail in copending application Ser. No. 079,846 filed Jul. 30, 1987, now abandoned.

Pins 1 ($\overline{\text{RESET}}$), 10, 11, 12, 13 and 14 of timer circuit 423 are connected to the 5.0 V supply. Pin 7 is connected to ground. The $\overline{Q}$ output (pin 6) is connected to the D input (pin 2). The valid transmission output $V_T$, line 91, from decoder integrated circuit 438 is connected to the CLK input (pin 3) of timer circuit 423 and to the anode of diode 419. The cathode of diode 419 is connected to one terminal of capacitor 415, and to corresponding terminals of resistors 417 and 421. The other terminals of capacitor 415 and resistor 417 are connected to ground. The other terminal of resistor 421 is connected to the $\overline{\text{SET}}$ input (pin 4) of timer circuit 423. The Q output (pin 5) of timer circuit 423 is connected to one terminal of resistor 425.

The other terminal of resistor 425 is connected to the base of transistor 429. The emitter of transistor 429 is connected to ground. The collector of transistor 429 is connected to the cathode of light-emitting diode 427. The anode of light-emitting diode 427 is connected to the cathode of zener diode 431, to the anode of zener diode 433, and to one terminal of resistor 435. The anode of zener diode 431 is connected to ground. The other terminal of resistor 435 is connected to the collector of transistor 439 and one terminal of resistor 435. The other terminal of resistor 437 is connected in common to the emitter of transistor 439, the cathode of diode 441 and the anode of zener diode 443. The cathode of zener diode 443 is connected to the cathode of zener diode 433 and one terminal of PTC resistor 445. The other terminal of PTC resistor 445 is connected to the cathode of diode 447, the anode of diode 447 being connected to the +24 V full wave supply.

The anode of diode 441 is connected to the base of transistor 439 and one terminal of resistor 453. The other terminal of resistor 453 is connected to the relay on/off line 550 in power controller 12. When the relay is on, line 550 is held close to ground. When the relay is off, line 550 floats to +24 V.

Infrared receiver diode 412 receives infrared signals which are selected by the tuned circuit formed by variable inductor 414 and capacitors 416 and 418. The selected signal is then applied to the input of amplifier/-demodulator integrated circuit 424. The amplified and demodulated output signal is applied to the input of decoder integrated circuit 438. The digital output produced is converted to an analog signal by resistors 444, 446, 448, 450 and 452, and applied to the positive input of integrated circuit 407 which acts as a buffer amplifier. The output of integrated circuit 407 is applied to one terminal of relay contact 484. Diodes 411 and 413 serve to clamp the output voltage from integrated circuit 407 to be no greater than V+ or less than ground.

When a valid output is available at the digital output terminals of decoder integrated circuit 438, then line 91 goes high. This causes the voltage on the cathode of diode 464 to go high and transistor 474 to turn on, and allows current to flow through relay coil 480, closing relay contacts 449 and 484 and applying the analog output signal to line 93. Capacitor 462 then charges through resistor 466. When line 91 goes low, capacitor 462 is kept charged at +5 V by contacts 449 which remain closed as do contacts 484 since they are contacts of a latching relay. Diode 464 protects the base-emitter junction of transistor 474.

If take-command line 95 goes low then transistor 476 is turned on and receives base current through relay coil 480 and resistor 472. Collector current flows through relay coil 482 and causes relay contacts 449 and 484 to open. This causes capacitor 462 to discharge through resistor 460, with the discharge current flowing through diode 464. Transistor 474 is turned off and the energy stored in relay coil 480 circulates through protection diode 468. Diode 458 protects the output terminal of decoder integrated circuit 438.

Take-command line 95, going high, causes transistor 476 to turn off and the energy stored in relay coil 482 circulates through protection diode 478. Diode 470 allows take command line 95 to be pulled low when transistor 474 turns on thus relinquishing command at all other connected stations.

The operation of the circuitry that drives light-emitting diode 427 is as follows. In the absence of a received signal, the Q output of timer circuit 423 is high and transistor 429 is on. If the load is also on, then the on/off input is low and transistor 439 is also on. Hence, a relatively large amount of current flows through light-emitting diode 427 and the latter glows brightly, indicating that the load is on.

$V_T$(line 91) goes high each time a valid transmission (i.e. with a frequency of 20 Hz) is received by the receiver. Timer circuit 423 is set up as a divide-by-2 counter so that the Q output (pin 5) oscillates at a frequency of 10 Hz. This causes transistor 427 to turn on and off at that frequency so that light-emitting diode 427 blinks at the 10 Hz frequency, indicating the reception of a signal from the transmitter.

When valid transmissions are no longer received, the Q output goes high, turning transistor 427 on once again. If the result of the transmission was to turn the load off, then the on/off input is high and transistor 439 is now off. The current flowing through light-emitting diode 427 also has to flow through resistor 437, and it is a much lesser value than previously. Hence light-emitting diode 427 glows more dimly, indicating that the load is off.

The various diodes and zener diodes are for the protection of transistors 429 and 439.

The presently preferred values of resistors and capacitors for the circuit of FIG. 5 are given in Table II below. All resistors are 0.5 W power rating unless otherwise stated.

TABLE II

| RESISTOR | VALUE IN OHMS | CAPACITOR | VALUE |
|---|---|---|---|
| 404 | 3.3 k | 408 | 100 uF |
| 405 | 10 k | 415 | 1 uF |
| 409 | 30.1 k | 416 | 150 pF |
| 410 | 22 | 418 | 680 pF |
| 417 | 1 M | 420 | 3.3 nF |
| 421 | 1 k | 422 | 22 nF |
| 425 | 15 k | 426 | 1 nF |
| 435 | 810 | 428 | 47 nF |
| 437 | 43 k | 430 | 330 pF |
| 442 | 33 k | 434 | 1000 pF |
| 444 | 20 k | 436 | 22 uF |
| 446 | 40 k | 440 | 10 nF |
| 448 | 80 k | 454 | 10 nF |
| 450 | 10 k | 462 | 2.2 uF |
| 451 | 68 | | |
| 452 | 160 k | | |
| 453 | 33 k | | |
| 456 | 645 k | | |
| 460 | 1 M | | |
| 466 | 56 k | | |
| 472 | 56 k | | |

PTC resistors 401 and 445 are preferably 180 ohms. Light-emitting diode 427 is preferably a Martec 530-0.

Diodes 419, 458, 464, 468, 470 and 478 are preferably type 1N 914. Diodes 402, 411, 413, 441 and 447 are preferably type 1N 4004. Zener diode 403 is a type 1.5 KE 39 A. Zener diode 406 preferably has a zener voltage of 5.0 V. Zener diodes 341 and 433 preferably have zener voltages of 33 V. Zener diode 443 preferably has a zener voltage of 10 V. Receiver diode 412 is preferably a Siemens type SFH205. Transistors 429, 474 and 476 are preferably type MPSA29. Transistor 439 is preferably a type MPS 1992. Amplifier/demodulator integrated circuit 424 is preferably a Signetics type TDA 3047. Decoder integrated circuit 438 is preferably a Motorola type MC 145029. Integrated circuit 407 is preferably a Motorola type MC 33172P. Timer circuit 423 is preferably a 74HC74. Variable inductor 414 preferably has a maximum value of 18 mH. Inductor 432 preferably has a maximum value of 4 mH. Relay coils 480 and 482 and relay contacts 449 and 484 together form a latching type relay, for example an Omron G5AK237POC24.

Figure 6:
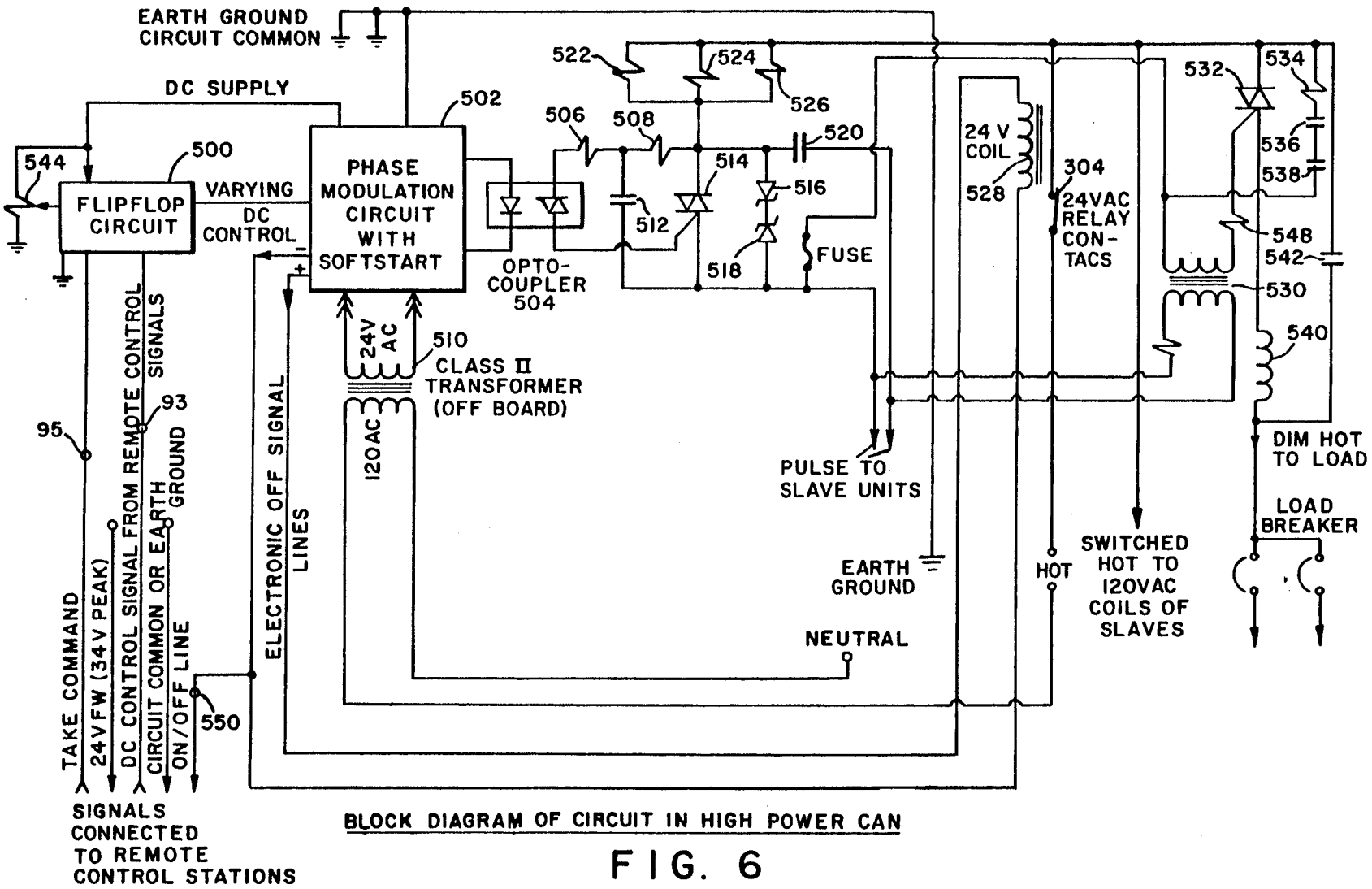
FIG. 6 is a block diagram showing the power controller of the present invention.

As shown in FIG. 6, the power controller of the present invention receives signals from the receiver or another control station and outputs a phase-controlled output voltage. To this end, flip-flop circuit 500 is connected to power-up preset potentiometer 544, analog signal line 93 and take-command line 95. Its output is connected to phase modulation circuit 502, and it receives power from a D.C. supply. On first powering up the power controller, flip-flop circuit 500 assumes a state where the voltage tapped off power-up preset potentiometer 544 is applied to phase modulation circuit 502. When take-command line 95 is pulled low, flip-flop circuit 500 toggles, and the voltage on analog signal line 93 is applied to phase modulation circuit 502.

Phase modulation circuit 502 has outputs to relay 528, on/off control line 550 and optocoupler 504. If the voltage at the input to phase modulation circuit 502 is above a predetermined value, then voltage is applied to the coil of relay 528 causing its contacts to close, applying the voltage to main triac 532. Varying the input voltage to phase modulation circuit 502 above the predetermined value, produces an output signal of varying phase delay from the zero crossings of the A.C. line, which signal is applied to optocoupler 504. Phase modulation circuit 502 is powered from transformer 510.

The output from optocoupler 504 is applied to signal triac 514, gating the latter on. Resistors 522, 524 and 526 limit the current through triac 514 in the on state. Resistor 508 and capacitor 512 form an RC snubber for triac 514. Resistor 506 limits current in optocoupler 504. Capacitor 520 charges to a voltage limited by zener diodes 516 and 518 when triac 514 is in the off state. When signal triac 514 is gated on, capacitor 520 discharges and causes a pulse of current to flow through pulse transformer 530.

The pulse of current generated on the secondary side of pulse transformer 530, flows through gate resistor 548 and gates on main triac 532. Resistor 534 and capacitors 536 and 538 form a snubber for main triac 532. Inductor 540 and capacitor 542 form a radio frequency interference filter.

Thus, the output voltage from the power controller is phase-controlled A.C. voltage whose value depends on the voltage on analog signal line 93. In the event this voltage is adjusted to be below a certain predetermined value, then power relay 528 will open to provide a positive air gap between the power source and the output. On restoration of power following a power failure, the output voltage will depend on the setting of power preset potentiometer 544.

Figure 7A:
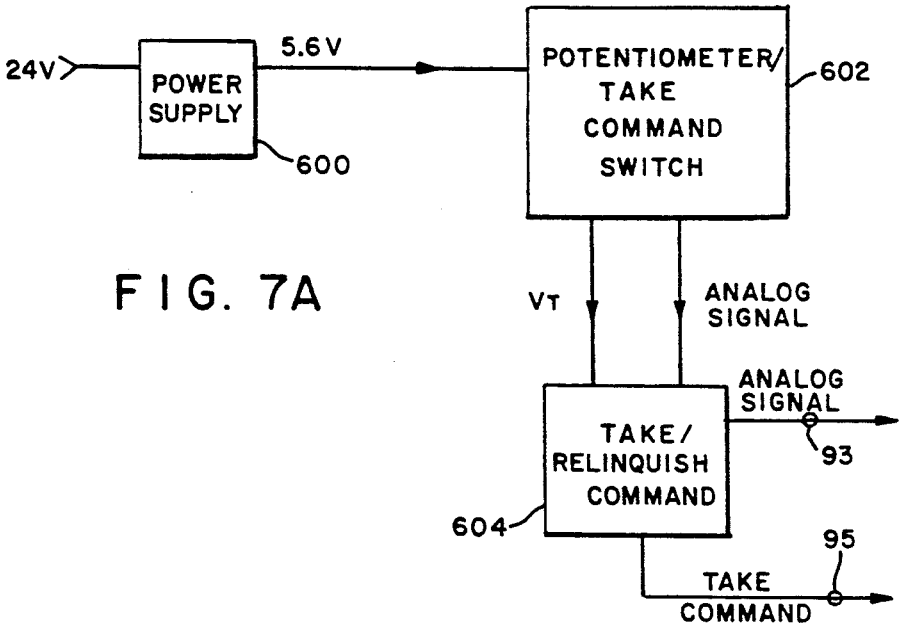
FIG. 7A is a block diagram of the control station of the present invention.

A suitable control station 10, for use with the power controller described in FIG. 6, is shown in block diagram form in FIG. 7A, and comprises power supply 600, potentiometer/take command switch circuit 602 and take/relinquish command circuit 604. Power supply 600 has as its input, a source of 24 Vrms full wave rectified direct current, and outputs a regulated 5.6 V to potentiometer/take command switch circuit 602. The outputs from potentiometer/take command switch circuit 602 are an analog signal voltage and a take-command signal. These are connected to take/relinquish command circuit 604. Take/relinquish command circuit 604 is connected to analog signal bus 93 and take command bus 95.

If a take-command signal is received by take/relinquish command circuit 604 from potentiometer/take command switch circuit 602, then the analog output signal from circuit 602 is connected to analog signal bus 93, and all other signal generators are disconnected from this bus. This state will persist until another control station or an infrared receiver takes command, which causes take-command bus 95 to go low and the analog output signal from circuit 602 to be disconnected from analog output bus 93.

Figure 7B:
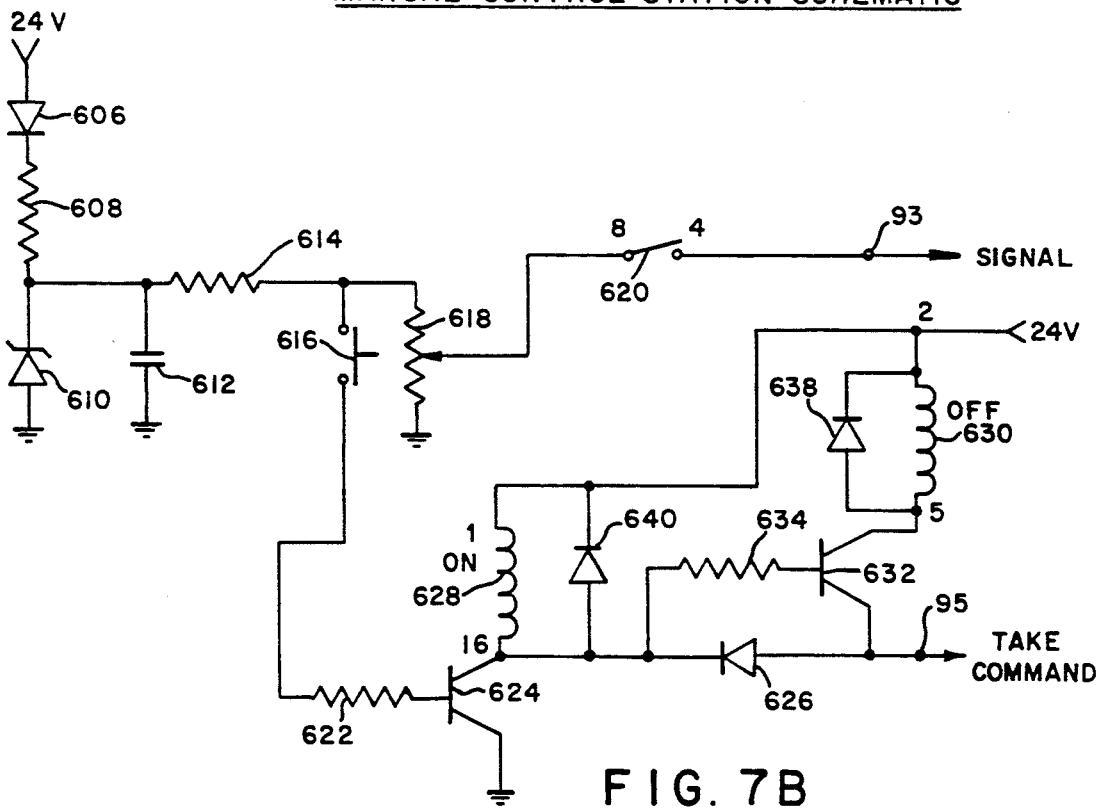
FIG. 7B is a circuit schematic of the control station of the present invention.

The control station embodiment illustrated schematically in FIG. 7B is the presently preferred embodiment of the control station block-diagrammed in FIG. 7A, wherein power supply circuit 600 comprises diode 606, resistors 608 and 614, zener diode 610, and capacitor 612. The positive terminal of the 24 Vrms source is connected to the anode of diode 606, the cathode of which is connected to one terminal of resistor 608, the other terminal of resistor 608 being connected in common to the cathode of zener diode 610, one terminal of capacitor 612 and one terminal of resistor 614. The anode of zener diode 610 and the other terminal of capacitor 612 are connected to ground. A regulated voltage of 5.6 V is produced at the cathode of zener diode 610 and this is connected to potentiometer/take-command switch circuit 602.

Circuit 602 comprises switch 616 and potentiometer 618, which can be a linear or rotary potentiometer. One terminal of potentiometer 618 is connected to the free terminal of resistor 614, the other terminal being connected to ground. The wiper is connected to switch contacts 620 in take/relinquish command circuit 604. One terminal of switch 616 is connected to the junction between resistor 614 and potentiometer 618. The other terminal of switch 616 is connected to one terminal of resistor 622 in take/relinquish command circuit 604. By varying the setting of potentiometer 618, a varying analog voltage can be applied to one terminal of switch contacts 620.

Switch 616 can be a separately actuable switch such as a push button, microtravel switch or it can be integrated with the actuator for potentiometer 618 such that when potentiometer 618 is adjusted, then switch 616 is closed, as described in aforementioned U.S. Pat. No. 4,689,547.

Take/Relinquish command circuit 604 comprises resistors 622 and 634, transistors 624 and 632, diodes 626, 638 and 640, latching relay coils 628 and 630, and relay switch contacts 620. The base of transistor 624 is connected to the other terminal of resistor 622, the emitter being connected to ground. The collector of transistor 624 is connected in common to relay coil 628, the anode of diode 640, one terminal of resistor 634 and the cathode of diode 626. The anode of diode 626 is connected to the emitter of transistor 632 and take-command line 95. The other terminal of resistor 634 is connected to the base of transistor 632. The collector of transistor 632 is connected to the anode of diode 638 and one terminal of relay coil 630. The cathodes of diodes 638 and 640 and the free terminals of relay coils 628 and 630 are connected to the positive terminal of the 24 Vrms source.

Closing take-command switch 616 causes base current to flow through resistor 622 turning transistor 624 on. Collector current flows through relay coil 628 closing switch contacts 620 and connecting the wiper of potentiometer 618 to analog signal bus 93. Also, take-command bus 95 is pulled low, disconnecting all other signal generators. When switch 616 is released, transistor 624 stops conducting, the energy stored in relay coil 628 circulates through protection diode 640, but switch contacts 620 remain closed. Take-command bus 95 can float high again.

When take command bus 95 is next pulled low due to an IR receiver or another control station taking command, base current flows through relay coil 628 and resistor 634 turning transistor 632 on. This allows collector current to flow in relay coil 630, opening switch contacts 620. When take-command bus 95 floats high again, transistor 632 turns off, the energy stored in relay coil 630 is circulated through protection diode 638 and switch contacts 628 remain open.

The presently preferred values of components in FIG. 7B are as follows. Resistors are all 0.5 W power rating. Resistor 608 has a value of 3.6 kilohms, resistor 614 has a value of 1 kilohm, resistor 622 has a value of 3.3 megohms, and resistor 634 has a value of 31 kilohms. Capacitor 612 has a value of 47 uF. Diode 606 is preferably a type 1N 4004. Diodes 626, 638 and 640 are types 1N 914. Zener diode 610 has a zener voltage of 5.6 V. Transistors 624 and 632 are type MPS A28. Relay coils 628 and 630 and switch contacts 620 together form a latching type relay. Potentiometer 618 has a value of 10 kilohms.

Figure 8:
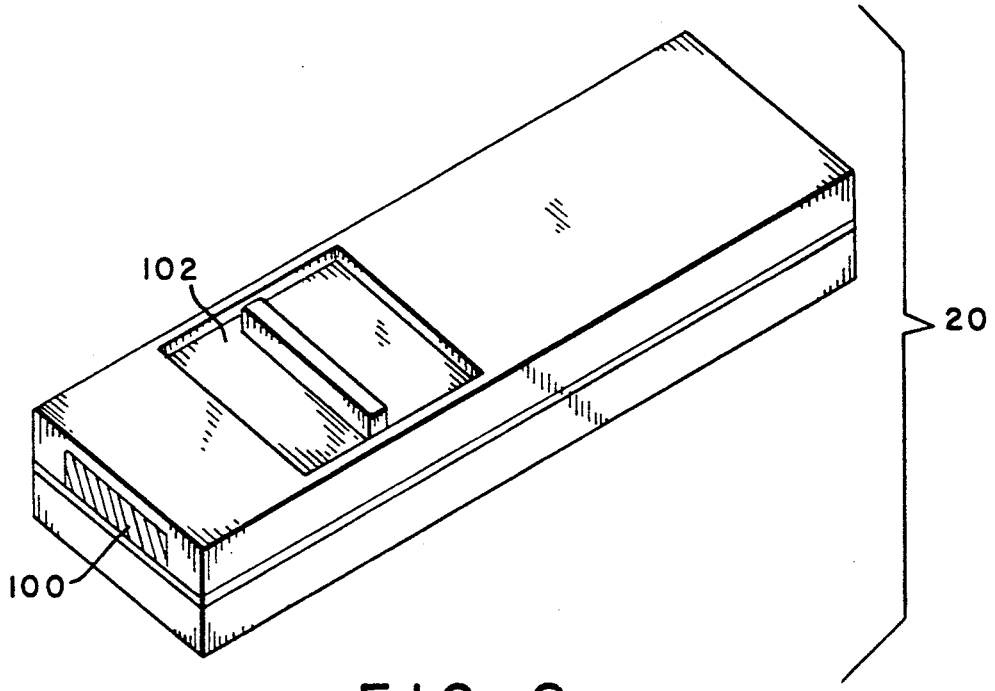
FIG. 8 is a perspective view of the mechanical aspects of the preferred embodiment of the transmitter of the present invention.

As shown in FIG. 8, transmitter 20 can be contained in a housing adapted to be comfortably held in the operator's hand. Infrared light-emitting diodes 50, 51, 52 and 53 are located behind plastic window 100 which is transparent to infrared light. Slider 102 is connected to the operator shaft for wiper 42 of potentiometer 34. Switches 54 and 56 are coupled to slider 102 as described in aforementioned U.S. Pat. No. 4,689,547 incorporated herein by reference.

Figure 9A:
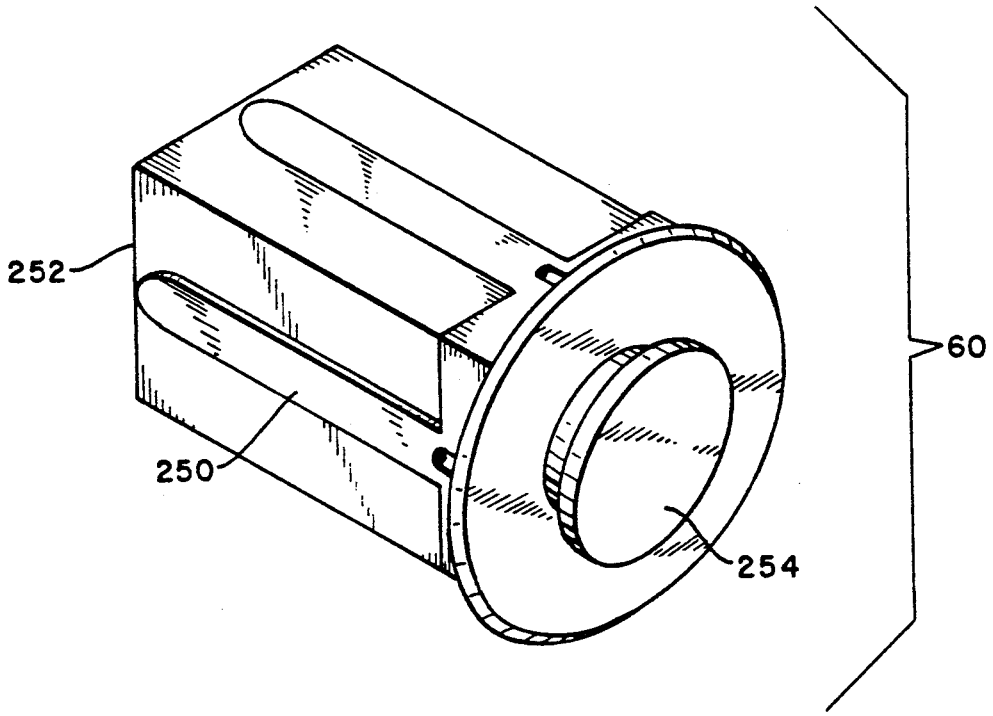
FIG. 9A is a perspective view of the mechanical aspects of the preferred embodiment of the receiver of the present invention.

As shown in FIG. 9A, receiver 60 can be contained in a housing adapted for mounting in plaster or lay-in tile ceilings. Infrared detector diode 82 is located behind a cylinder of material that has a high infrared transmittance. Housing 252 contains the receiver circuitry. Mounting clip 250 is used for fixing receiver 60 to the ceiling.

Figure 9B:
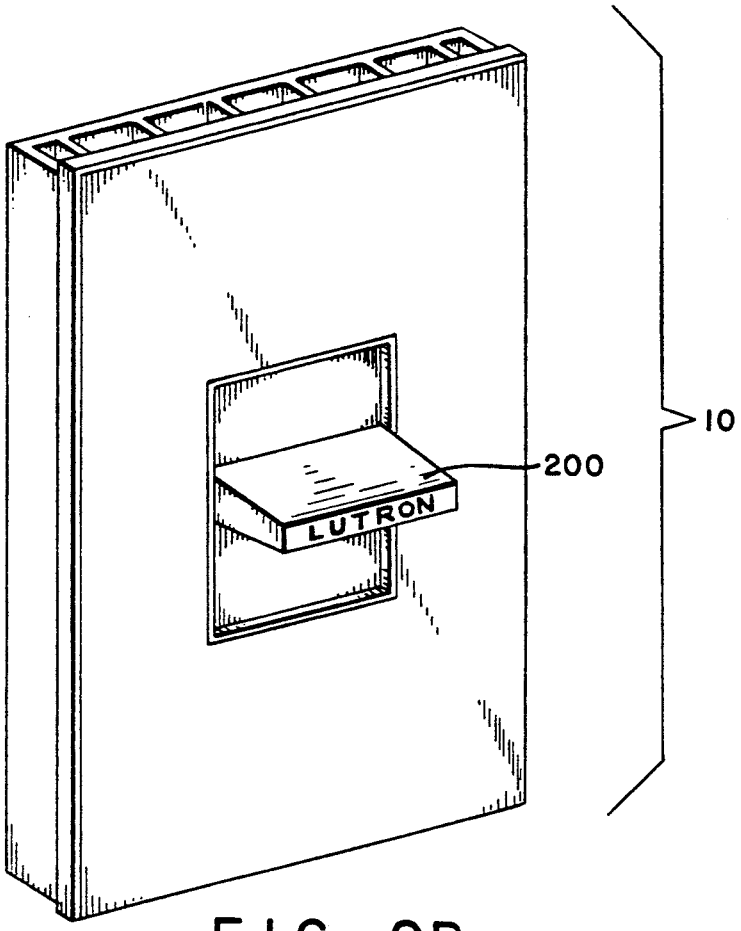
FIG. 9B is a perspective view of the mechanical aspects of the preferred embodiment of the control station of the present invention.

As shown in FIG. 9B, control station 10 has slider 200 which is coupled to the actuator shaft of the wiper of potentiometer 618. Switch 616 can also be coupled to slider 200 as described in previously noted U.S. Pat. No. 4,689,547.

Figure 10:
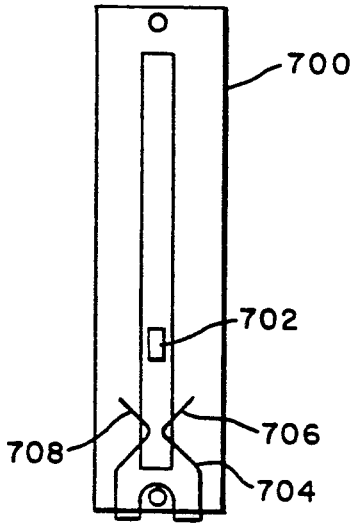
FIG. 10 is a plan view of a modified linear potentiometer suitable for use with the transmitter of the invention.

FIG. 10 illustrates a modified linear potentiometer suitable for use with the transmitter of the present invention. Since the transmitter transmits an off signal, which opens up an airgap switch in the controller when the slider is moved to one end of its travel, it is preferable to give the operator of the transmitter the sensory impression that a switch in the transmitter has been opened. This can be done by attaching spring 704 (shaped as shown in FIG. 10 and typically formed of steel or the like) to linear potentiometer 700. In order to move actuator 702 of linear potentiometer to the end of its travel, it is now necessary also to force arms 706 and 708 of spring 704 apart against the bias of the spring. Thus, a definite resistance to motion (i.e., a "detent") should be felt. If actuator 702 is moved from one end toward the center of its travel, a lesser frictional force should be felt until the actuator slips free of spring arms 706 and 708. In this manner a switch is simulated that appears relatively hard to open but easy to close.

It should be apparent to one skilled in the art that, although the implementation hereinbefore described employs an infrared communications link between the transmitter and receiver, that link can readily be provided as an audio, ultrasonic, microwave or radio frequency link as well. It should also be apparent to one skilled in the art that it is possible to have multiple transmitters, each operating on a different channel contained within the same housing, and corresponding receivers for each transmitter. Alternatively, the system may use one transmitter that can be set to operate on each of a number of different channels by using a selector switch. Furthermore, the signal between the transmitter and the receiver can be an amplitude-modulated, frequency-modulated, phase-modulated, pulse width-modulated or digitally encoded signal.

Since these and certain other changes may be made in the above apparatus and method without departing from the scope of the invention herein involved, it is intended that all matter contained in the above description or shown in the accompanying drawings shall be interpreted in an illustrative and not a limiting sense.

We claim:

1. A remotely controlled power control system comprising, in combination:

(a) means for transmitting a radiant control signal, including actuator means, manually movable through a range of positions, information contained in said control signal depending upon the position of said actuator means;

(b) means for detecting said control signal and for providing an output signal that is determined by said information contained in said control signal; and (c) means responsive to said output signal for controlling power delivered to an AC load, whereby the power to said load is adjustable through a range of values that are immediately determined upon the positioning of said actuator means.

2. The system of claim 1 in which said control signal is electromagnetic.

3. The system of claim 2 in which said control signal is an infrared signal.

4. The system of claim 2 in which said control signal is a radio frequency signal.

5. The system of claim 1 in which said control signal is an acoustic signal.

6. The system of claim 5 in which said control signal is an ultrasonic signal

7. The system of claim 1 in which said control signal is amplitude modulated.

8. The system of claim 1 in which said control signal is frequency modulated.

9. The system of claim 1 in which said control signal is phase modulated.

10. The system of claim 1 in which said control signal is pulse-width modulated.

11. The system of claim 1 which said control signal is digitally encoded.

12. The system of claim 1 in which said control signal is a multichannel signal.

13. The system of claim 12 further comprising channel selector means.

14. The system of claim 1 in which said transmitter means is battery-powered.

15. The system of claim 1 in which said actuator means is manually operable along a substantially linear path.

16. The system of claim 1 in which said actuator means is manually operable along a substantially planar rotational path.

17. The system of claim 1 in which said actuator means is positionable for turning off power to said load.

18. The system of claim 17 in which said actuator power-off position has a detent.

19. The system of claim 1 in which said actuator means position determines the value of a variable impedance.

20. The system of claim 1 further comprising at least one additional transmitter means.

21. The system of claim 1 in which said transmitter means further comprises switch means for enabling and disabling transmission of said control signal.

22. The system of claim 21 in which said switch means is mechanically coupled to said actuator means.

23. The system of claim 22 in which said switch means is a push-button on said actuator means.

24. The system of claim 21 in which said switch means comprises a mechanical switch.

25. The system of claim 21 in which said switch means comprised an electronic switch.

26. The system of claim 22 in which said switch means enables transmission of said control signal substantially instantaneously on positioning of said actuator means and disables transmission of said control signal after positioning of said actuator has ceased.

27. The system of claim 26 in which said switch means comprises a mechanical switch.

28. The system of claim 26 in which said switch means comprises an electronic switch.

29. The system of claim 26 in which said switch means enables transmission of said control signal substantially instantaneously on positioning of said actuator means, even if said actuator means is initially substantially at an extreme end of its position range.

30. The system of claim 26 in which said switch means disables transmission of said control signal after a delay time of not more than one seocnd after positioning of said actuator means has ceased.

31. The system of claim 1, further comprising a source of an auxiliary signal for controlling the power delivered to the load.

32. The system of claim 31 in which the source of the auxiliary signal comprises at least one non-radiant signal source.

33. The system of claim 32 in which said non-radiant signal source is in electrical contact with said control means.

34. The system of claim 33 further comprising switch means for enabling said non-radiant signal source.

35. The system of claim 34 in which said switch means comprises a push-button on said non-radiant signal source.

36. The system of claim 31 in which said transmitter means further comprises switch means for enabling and disabling transmission of said control signal.

37. The system of claim 36 in which said switch means is mechanically coupled to said actuator means.

38. The system of claim 37 in which said switch means is a push-button on said actuator means.

39. The system of claim 36 in which said switch means comprises a mechanical switch.

40. The system of claim 36 in which said switch means comprises an electronic switch.

41. The system of claim 37 in which said switch means enables transmission of said control signal substantially instantaneously on positioning of said actuator means and disables transmission of said control signal after positioning of said actuator means has ceased.

42. The system of claim 41 in which said switch means comprises a mechanical switch.

43. The system of claim 41 in which said switch means comprises an electronic switch.

44. The system of claim 31 further comprising means for deciding whether the power control means is to be directed by said radiant control signal or said auxiliary signal.

45. The system of claim 1 in which said detector means and controller means are combined in a single unit.

46. The system of claim 1 further comprising at least one additional controller means.

47. The system of claim 1 in which said AC load comprises lighting.

48. A remotely controlled power control system comprising, in combination:

(a) means for tranmitting a radiant control signal, including actuator means, manually movable through a range of positions, which
  (i) enables transmission, substantially instantaneously on positioning of said actuator means, of the control signal determined by the actuator position, and
  (ii) disables transmission of said control signal after positioning has ceased;

(b) means for detecting said control signal and for providing an output signal that is determined by said control signal; and (c) means responsive to said output signal for controlling power to a load.

whereby the power to said load is adjustable through a range of values that are immediately determined upon the positioning of said actuator means.

49. The system of claim 48 in which said transmitter means is battery-powered.

50. The system of claim 48 in which said control signal is electromagnetic.

51. The system of claim 48 in which said control signal is digitally encoded.

52. The system of claim 48 in which said actuator means is manually operable along a substantially linear path.

53. The system of claim 48 in which said actuator means comprises mechanical switching means.

54. The system of claim 48 in which said controller means controls a lighting load.

55. The system of claim 48 further comprising a source of an auxiliary signal provided to the controller by electrical conduction.

56. The sytem of claim 55 in which said auxiliary signal source comprises auxiliary actuator means, which provides, substantially instantaneously on positioning of said auxiliary actuator means, the auxiliary signal determined by the auxiliary actuator position.

57. The system of claim 55 further comprising push-button switching means for enabling said auxiliary signal source.

58. A remotely controlled power control system comprising, in combination:

(a) means for transmitting a radiant control signal, including actuator means, manually movable through a range of positions, information contained in said control signal depending upon the position of said actuator means;

(b) means for detecting said control signal and for providing an output signal that is determined by said information contained in said control signal;

(c) an auxiliary signal source for providing an auxiliary signal by electrical conduction, said auxiliary signal source comprising auxiliary actuator means, manually movable through a range of positions, which provides, on positioning of said auxiliary actuator means, the auxiliary signal determined by the auxiliary actuator position; and (d) means for controlling power to a load in accordance with a signal selected from the group consisting of said auxiliary signal and said output signal, whereby the power to said load is adjustable through a range of values that are immediately determined upon the positioning of one of said auxiliary actuator and said transmitter means actuator.

59. The system of claim 58 in which the positionable actuator means is manually operable along a substantially linear path.

60. The system of claim 58 in which the auxiliary actuator means is manually operable along a substantially linear path.

61. The system of claim 58 in which the transmitter means enables transmission of said control signal substantially instantaneously on positioning of said actuator means and disables transmission of said control signal after positioning of said actuator means has ceased.

62. The system of claim 58, further comprising at least one additional auxiliary signal source.

63. The system of claim 58 in which said load comprises lighting.

64. The system of claim 58 in which said transmitter means is battery-powered.

65. The system of claim 58 in which said control signal is electromagnetic.

66. The system of claim 58 in which said control signal is digitally encoded.

67. A remotely controlled power control system comprising, in combination:

(a) means for transmitting a radiant control signal, including actuator means, manually movable through a range of positions, which (i) enables transmission, substantially instantaneously on positioning of said actuator means, of the control signal determined by the actuator position, and (ii) disables transmission of said control signal after positioning has ceased;

(b) means for detecting said control signal and for providing an output signal that is determined by said control signal;

(c) an auxiliary signal source for providing an auxiliary signal by electrical conduction, said auxiliary signal source comprising auxiliary actuator means, manually movable through a range of positions, which provides, substantially instantaneously on positioning of said auxiliary actuator means, the auxiliary signal determined by the auxiliary actuator position; and (d) means for controlling power to a load in accordance with a signal selected from the group consisting of said auxiliary signal and said output signal, whereby the power to said load is adjustable through a range of values that are immediately determined upon the positioning of one of said auxiliary actuator and said transmitter means actuator.

68. The system of claim 67 in which the positionable actuator means is manually operable along a substantially linear path.

69. The system of claim 67 in which the auxiliary actuator means is manually operable along a substantially linear path.

70. The system of claim 67, further comprising at least one additional transmitter means.

71. The system of claim 67, further comprising at least one additional auxiliary signal source.

72. The system of claim 67 in which said load comprises lighting.

73. The system of claim 67 in which said transmitter is battery-powered.

74. The system of claim 67 in which said control signal is electromagnetic.

75. The system of claim 67 in which said control signal is digitally-encoded.

76. A remotely controlled power control system comprising, in combination, (a) a transmitter comprising means for transmitting a radiant control signal, including actuator means, manually movable through a range of positions, which enables transmission, substantially instantaneously on positioning of said actuator means, of the control signal determined by the actuator position, (b) means for detecting said control signal and for providing an output signal that is determined by said control signal, and (c) means responsive to said output signal for controlling power to a load, whereby the power to said load is adjustable through a range of values that are immediately determined upon the positioning of said actuator means.

77. The system of claim 76 in which said control signal comprises a plurality of transmission sequences and said transmission is maintained, after actuator motion ceases, for a time sufficient to transmit a valid transmission sequence.

78. The system of claim 76 in which said load comprises lighting.

79. A remotely controlled power control system comprising, in combination, (a) a transmitter comprising:

(i) means for transmitting a radiant control signal, including actuator means, manually movable through a range of positions, information contained in said control signal depending upon the position of said actuator means; and (ii) push-button switch means, mechanically coupled to said actuator means, for enabling and disabling transmission of said control signal;

(b) means for detecting said control signal and for providing an output signal that is determined by said information contained in said control signal, and (c) means responsive to said output signal for controlling a lighting load, whereby power to said load is adjustable through a range of values that, upon actuation of the push button to an enabling mode, are immediately determined upon the positioning of said actuator means.

80. The system of claim 79 in which said control signal is digitally-encoded.

81. The system of claim 79 in which said actuator means is manually operable along a substantially linear path.

82. The system of claim 79 in which said transmitter is battery-powered.

83. The system of claim 79 in which said control signal is electromagnetic.

84. The system of claim 79 further comprising a source of an auxiliary signal provided to the controller by electrical conduction.

85. A remotely controlled power control system comprising a transmitter comprising:

(a) means for transmitting a radiant control signal, including actuator means, manually movable through a range of positions, information contained in said control signal depending upon the position of said actuator means; and (b) push-button switch means, mechanically coupled to said actuator means, for enabling and disabling transmission of said control signal;

in which said actuator means is manually operable along a substantially linear path, the transmitter is battery-powered, the control signal is electromagnetic and digitally encoded, and the system further comprises means for detecting said control signal and for providing an output signal that is determined by said information contained in said control signal and means responsive to said output signal for controlling a lighting load, whereby power to said load is adjustable through a range of values that, upon actuation of the push-button to an enabling mode, are immediately determined upon the positioning of said actuator means.

86. A transmitter for remote control of a system, comprising means for transmitting a radiant control signal, including positionable actuator means, whose position determines said control signal, wherein said control signal comprises of plurality of transmission sequences and said transmission is maintained, after positioning of said actuator has ceased, for a time sufficient to transmit a valid transmission sequence.

87. A transmitter for remote control of a system, comprising means for transmitting a radiant control signal, including positionable actuator means, whose position substantially instantaneously determines said control signal, in which the transmitter transmits the control signal that corresponds to an actuator position for a time not longer than one second after positioning of said actuator has ceased.

88. A remotely controlled power control system comprising, in combination, (a) a transmitter comprising means for transmitting a radiant control signal, including positionable actuator means, information contained in said control signal depending upon the position of said actuator means, in which said actuator means' positions include a position for turning the system off;

(b) means for detecting said control signal and for providing an output signal that is determined by said information contained in said control signal, and (c) means responsive to said output signal for controlling power to a load, whereby the power to said load is adjustable through a range of values that are immediately determined upon the positioning of said actuator means and in which the radiant signal for turning the system off causes an air gap switch to open in the controller means.

89. The system of claim 86, in which the actuator position that turns the system off has a detent.

90. The system of claim 89, in which said detent requires that a greater force be applied to said actuator to turn said system off than to turn said system on.

* * * * *

UNITED STATES PATENT AND TRADEMARK OFFICE
CERTIFICATE OF CORRECTION

Patent No.: 5,146,153

Dated: September 8, 1992

Inventor(s): David G. Luchaco, et al.

It is certified that error appears in the above-identified patent and that said Letters Patent is hereby corrected as shown below.

On the title page:

[73] Assignee: Lutron Electronics Co., Inc.
Coopersburg, PA

Signed and Sealed this

Ninth Day of March, 1993

*Attest:*

STEPHEN G. KUNIN

*Attesting Officer*

*Acting Commissioner of Patents and Trademarks*